United States Patent [19]

Staun et al.

[11] Patent Number: 4,715,401

[45] Date of Patent: Dec. 29, 1987

[54] HOSE STORAGE ACCESS MEANS FOR SHIPMENT OF APPLIANCE

[75] Inventors: Paul R. Staun, St. Joseph Township, Berrien County; Robert M. Weir, St. Joseph, both of Mich.; Dean R. Sommerfeld, Green Springs, Ohio

[73] Assignee: Whirlpool Corporation, Benton Harbor, Mich.

[21] Appl. No.: 947,650

[22] Filed: Dec. 30, 1986

[51] Int. Cl.[4] ..... A62C 35/00

[52] U.S. Cl. ..... 137/355.17; 248/68.1; 248/742; 248/75; 248/317; 137/374

[58] Field of Search ..... 137/374, 355.16, 355.17, 137/899; 248/68.1, 74.2, 312, 317

[56] References Cited

U.S. PATENT DOCUMENTS 2,542,442 2/1951 Weber ..... 248/68.1
3,392,747 7/1968 Waldrop ..... 137/374
3,456,680 7/1969 Martiniak ..... 137/355.17
3,880,188 4/1975 Oakley, Jr. et al. ..... 137/355.17

*Primary Examiner*—A. Michael Chambers
*Attorney, Agent, or Firm*—Hill, Van Santen, Steadman & Simpson

[57] ABSTRACT

A hose retainer is provided for removably securing hoses within a cabinet of the appliance. The retainer includes a hook for securing the apparatus to a structure inside the appliance, a slit for receiving an end of a hose, and in one embodiment at least one aperture for receiving an end of a second hose. In a second embodiment the apparatus includes an arm and projection for securing an end of the second hose. The appliance includes access ports for affording access to a portion of the hoses while they are in their stored position and further includes an electrical plug storage aperture for holding the electrical cord in a stored, yet accessible location during shipping.

16 Claims, 7 Drawing Figures

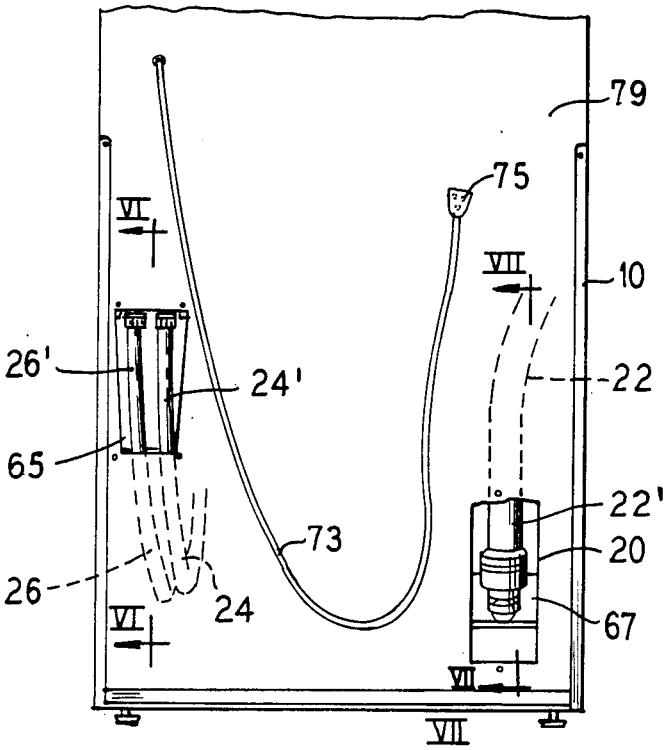
FIG. 5
FIG. 6
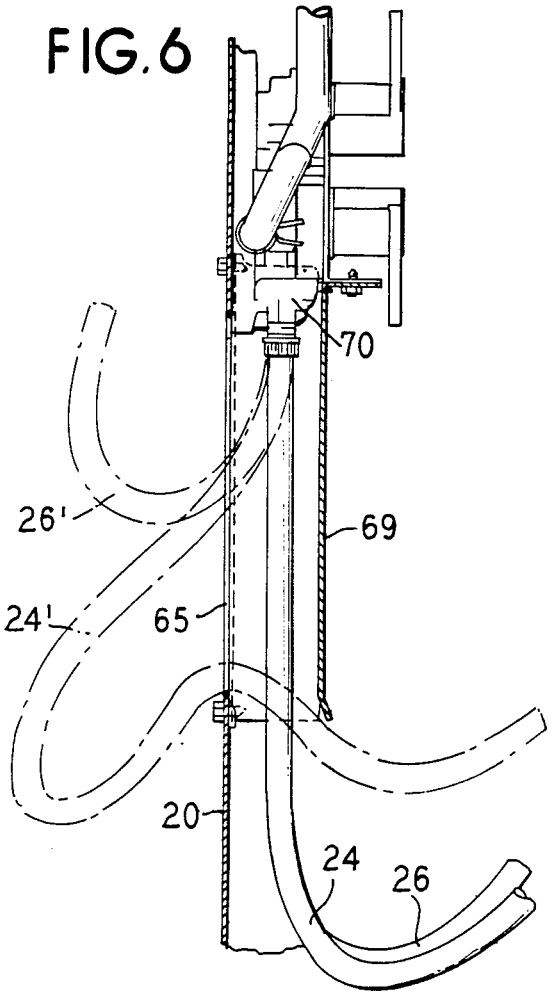
FIG. 7
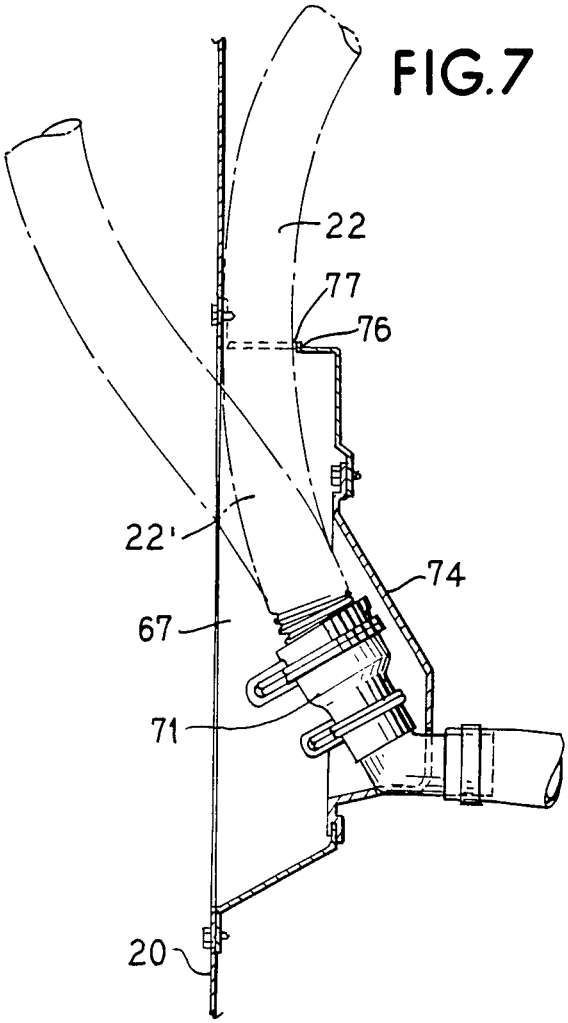

HOSE STORAGE ACCESS MEANS FOR SHIPMENT OF APPLIANCE

BACKGROUND OF THE INVENTION

1. Field of the Invention

The present invention relates to hose storage means particularly adapted for use in an appliance such as an automatic washing machine.

2. Description of the Prior Art

Home appliances such as, for example, an automatic washing machine, are provided with hoses that connect the appliance to a water source, such as a hot and cold water line, and a discharge line for discharging the water used by the appliance. For example, an automatic washing machine typically includes two inlet hoses, one for cold water and one for hot water, and a drain hose for discharging the water used to wash and rinse. Once the appliance is located in the home of the consumer, it is necessary for a serviceperson or the consumer to access the hoses so that the appliance can be set up for operation. However, these hoses typically are stored somewhere within the appliance so that they are not damaged during shipment of the appliance. Accordingly, the method of storing the hoses must be tempered with the need of access to the hoses so that the hoses can be attached to the inlets for the hot and cold water and to insure that the drain hose is situated in a suitable drain.

Usually, the hoses are loosely located within the appliance. For example, it is known to roll up and locate the hoses in the tub of the automatic washer for shipment of the appliance to the consumer. U.S. Pat. No. 3,880,188 discloses a hose retractor for a portable appliance. As disclosed, the hoses are normally stored within the cabinet when the appliance is not in use and pulled out for connection to a sink faucet. A hose retracting device facilitates retraction and storage of the hoses in the cabinet.

It would be advantageous to have an appliance that includes means for securing the hoses within the appliance yet provides a means for allowing easy access to the hoses to make the appliance operational.

SUMMARY OF THE INVENTION

The present invention provides an appliance that includes an apparatus that allows the drain hose and the inlet water hoses to be factory installed within the cabinet of the appliance. The appliance further includes access ports for selectively accessing the hoses.

An apparatus provided for removably securing the hoses within the cabinet of the appliance includes a hose retainer member having a hook portion for securing the apparatus to an internal portion of the appliance, as well as a slit for removably receiving a portion of a hose, for example the drain hose, and means for securing at least a second hose, for example, the inlet hose.

The means for securing the second hose may include at least one aperture that preferably includes projections that define a collar.

In another embodiment, the means for securing a second hose includes at least one arm having at the end thereof a slitted deformable projection sized and shaped to be received within an opening in the hose.

The appliance includes a cabinet having access ports for allowing access to corresponding portions of the drain hose and the inlet hoses. The cabinet also includes means for securing an electrical plug to the cabinet.

BRIEF DESCRIPTION OF THE DRAWINGS

FIG. 5 illustrates a back elevational view of a portion of the appliance of FIG. 1.

FIG. 6 illustrates a cross-sectional view of the appliance taken along lines VI—VI of FIG. 5.

FIG. 7 illustrates a cross-sectional view of the appliance taken along lines VII—VII of FIG. 5.

DETAILED DESCRIPTION OF THE PREFERRED EMBODIMENTS

Figure 1:
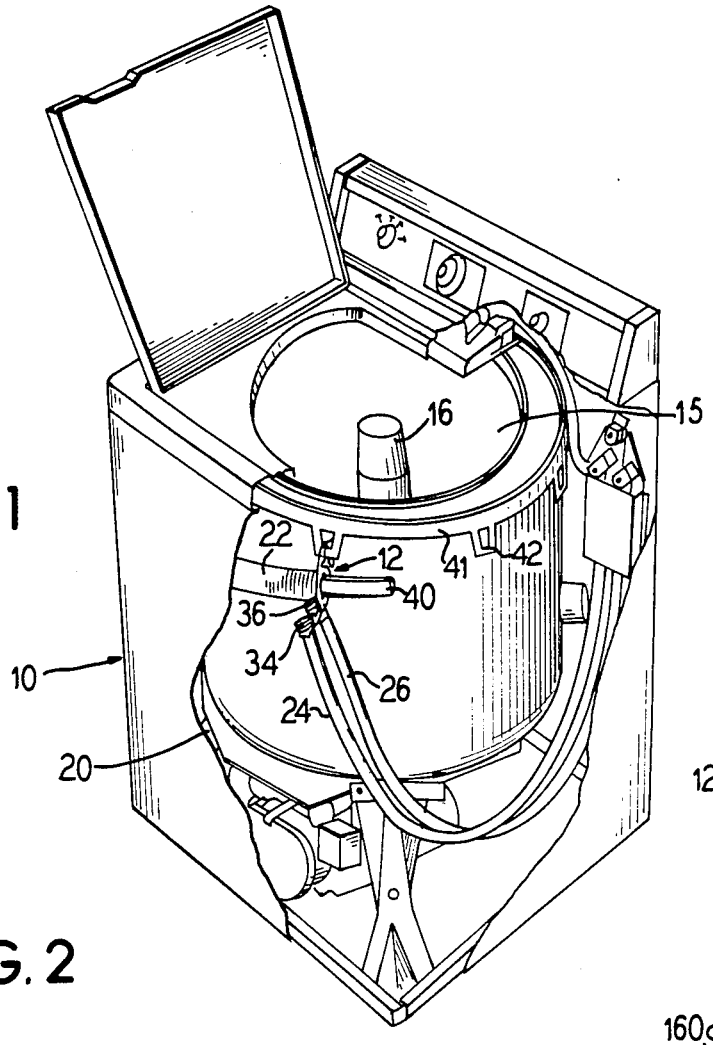
FIG. 1 illustrates a perspective view of the appliance of the present invention with parts broken away including the apparatus for securing the hoses within the appliance.

While the present invention provides a means for storing and accessing hoses within any appliance affording such utilitarian connection, the invention is particularly useful for providing an apparatus for effecting factory installation of hoses in a stored position in an automatic washing machine which are selectively retrievable at the place of utilization. Referring to FIG. 1, an exemplary automatic washing machine is shown at 10 utilizing a hose retainer 12 for removably securing hoses of the present invention.

The automatic washing machine 10 includes a tub 14 that has a clothes container or spin basket 15 in which an agitator 16 is centrally disposed. Circumscribing the top of the tub 14 is a retaining ring 41 that includes downwardly projecting flanges 42. The flange 42 provides a means to which the apparatus 12 for removably securing hoses may be attached. The tub 14, spin basket 15, and agitator 16 along with the drive mechanism are enclosed in a cabinet 20.

Figure 2:
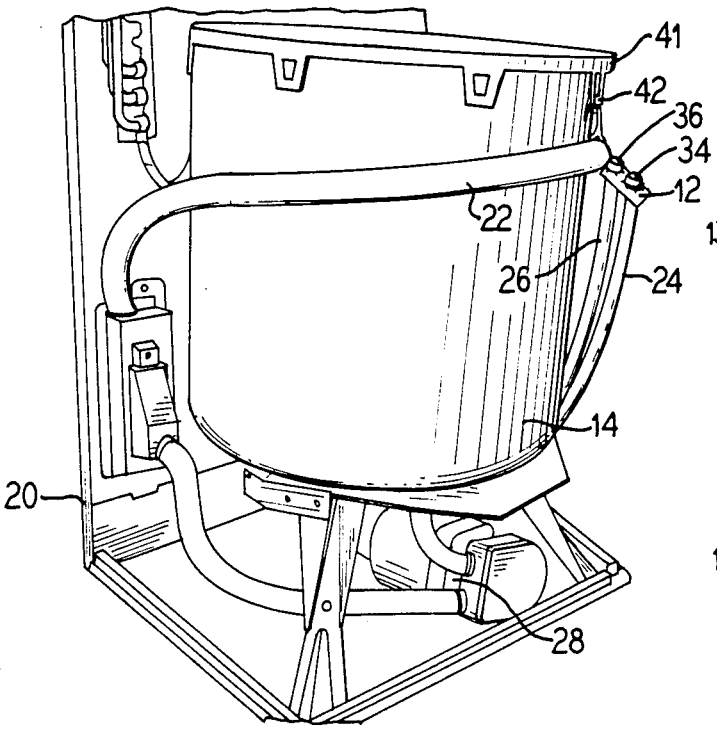
FIG. 2 illustrates a side elevational view of the appliance of FIG. 1 with parts broken away.

As illustrated in FIGS. 1 and 2, the automatic washing machine 10 includes a drain hose 22 and inlet hoses 24 and 26. The inlet hoses 24 and 26 are designed to be secured by the user to the usual domestic supply, i.e. an inlet water source such as a water faucet. The two inlet water hoses 24 and 26 are designed so that one hose can be connected to a cold water source and the other hose can be connected to a hot water source. The drain hose 22 is connected to a pump 28 that functions to pump the water contained within the tub 14 out of the tub and through the drain hose 22 for discharge to a drain, for example, within a basin, laundry tub, pipe drain or other means for allowing the disposal of the liquid drained from the tub 14.

In order to store hoses 22, 24, and 26 against possible damage to the hose and to the appliance 10 due to the hose being snagged or caught as the washing machine 10 is transported, it is desirable when the washing machines 10 are being constructed to store the hoses 22, 24, and 26 for relative safekeeping.

Figure 3:
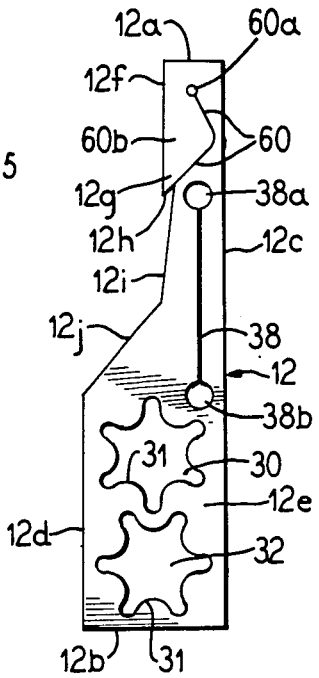
FIG. 3 illustrates one embodiment of a hose retainer for securing the hoses within the appliance.
Figure 4:
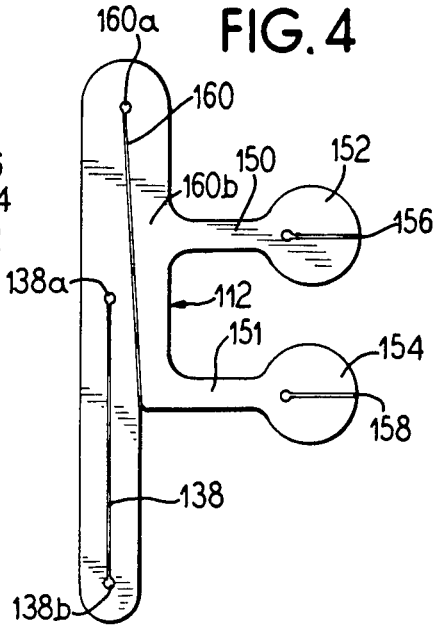
FIG. 4 illustrates another embodiment of a hose retainer for securing the hoses within the appliance.

Referring to FIGS. 3 and 4 two embodiments of a retainer apparatus or a hose retainer 12 for securing the hoses 22, 24, and 26 within the cabinet 20 of the washing machine 10 are illustrated.

Referring specifically to FIG. 3, the base retainer 12 includes a part having two apertures 30 and 32 that are designed to receive an end 34 and 36 of the hoses 24 and 26 respectively. The base retainer is an elongated sheet-form plastic member having end edges 12A and 12B and joined by a straight longitudinal edge 12C. The end adjacent the edge 12B is enlarged, i.e., it has a longitudinal edge 12D parallel to the edge 12C, thereby to form an enlarged area 12E sufficiently large to accommodate the formation of two hose apertures 30 and 32.

At the end 12*a* of the hose retainer 12, the sheet-form member is much narrower and has a longitudinal edge 12F which proceeds parallel to the edge 12C until it reaches an offset or lug 12G, at which point the offset or lug 12G is formed at reentrant angle 12H. The sheet-form body of the hose retainer 12 is slit at the angle of the hose retainer 12H as at 60 and the slit 60 is itself angled inwardly to terminate at a perforation 60A provided to prevent inadvertent tearing. There is thus formed a hook 60B by means of which the hose retainer 12 may be suspended from the flange 42 that extends downwardly from a ring 41 around the tub 14.

Preferably the apertures 30 and 32 include radial projections 31 that define a collar. Accordingly, in the embodiment illustrated, the apertures 30 and 32 have a star shaped construction wherein an end of the hoses 24 and 26 is insertably received within the apertures 30 and 32 and provides a collar for retaining the inserted ends 34 and 36 of the hoses. The hose retainer 12 also includes a longitudinal slit 38 terminating in openings 38A and 38B that is designed to receive an end portion 40 of the drain hose 22 in an interference fit relationship. The construction of the slit 38 allows the end 40 of the drain hose 22 to be removably retained therein. The longitudinal edge portion 12F and 12D are completed by an angled edge portion 121 and 12J as shown in FIG. 3.

Referring now to FIG. 4, a second embodiment of the retainer apparatus or hose retainer 112 for securing the hoses 22, 24, and 26 is illustrated. Like reference numerals increased by 100 will be used where appropriate. Similarly to the previous embodiment, the apparatus 112 includes a longitudinal slit 138 for receiving a portion 40 of the drain hose 22. Again, the slit 138 is constructed so that it will receive an end portion 40 of the drain hose 22. The apparatus 112 also includes arm members 150 and 151 that include circular projections 152 and 154 respectively sized and shaped to be received within apertures in the hoses 24 and 26. To this end, the circular projections 152 and 154 have a circumference that is substantially equal to the internal circumference of the ends 34 and 36 of the hoses. The circular projections 152 and 154 include slits 156 and 158 respectively that allow the circular projections 152 and 154 to be deformed so that their circumference can be reduced allowing them to be received within the openings of the hoses 24 and 26. Thus, the embodiment of retainer 112 is the inversion of the embodiment 12 and demonstrates how the inventive concept is utilized in both male and female species. The apparatus 112 also includes a hook 160B that is defined by a slit 160 in the base retainer 112. The hook 160B is deisgned to be received within the flange 42 so that the apparatus 112 can be secured to the tub 12.

The retainer apparatus 12 or 112 for removably securing the hoses 22, 24, and 26 is preferably constructed from a plastic material which is fairly rigid in that it is self-sustaining and exhibits good memory, but is also resiliently flexible, for example, high density polyethylene although other flexible materials known in the art may also be used.

Because the apparatus 12 or 112 is constructed from a flexible material, the hoses may be selectively pulled out of the cabinet 20. To this end, the apparatus 12 of 112 is constructed so that the hook member 60B or 160B will not readily tear away from the remaining portions of the hose retainer 12 or 112 or from the flange 42, but in response to a deliberate operator induced tearing action, the retainers 12 and 112 are frangible. Furthermore, while the end 40 of the drain hose 22 is normally retained in place, it can be pulled out of the slit 38 or 138 by a deliberate operator induced action. The inlet hoses 24 and 26 may remain secured to the hose retainer 12 or 112 but because the apparatus will not longer be secured to an internal structure in the cabinet the end user can remove the retaining apparatus 12 or 112 once the hoses 24 and 26 are pulled out of the appliance 10.

Referring now to FIG. 5, the automatic washing machine 10, and specifically the cabinet 20, includes access ports 65 and 67. The access ports 65 and 67 provide access to at least a portion of the hoses 22, 24, and 26 in order to afford selective removal of the hoses 22, 24, and 26 from the cabinet 20.

As illustrated in FIG. 6, the first access port 65 is disposed so that a portion 24′ and 26′ of the inlet hoses 24 and 26 is always visible and accessible through the opening 65. Preferably, the cabinet 20 includes a back-up plate 69 that is located behind the hoses 24 and 26 and thereby allows the hoses to be accessed but provides a contiguous structure to the cabinet 20 of the washing machine 10. The back-up plate 69 or bracket is secured to the inlet valve assembly 70 and both are in turn secured to the cabinet 20.

In the storage position the hoses are disposed as illustrated in FIGS. 1 and 2. To remove an end 34 and 36 of the inlet hoses so that they can be made operational, the portion of the hoses 24′ and 26′ accessible through the access port 65 is pulled outwardly causing the hoses 22 and 24 either to disengage the apparatus 12 or the apparatus 112 as the case may be, or the apparatus 12 is pulled away from the flange 42 of the tub 14. The hoses 24 and 26 are pulled until the ends 34 and 36 of the hoses 22 are pulled out from the access port 65. If the apparatus 12 is still secured to the ends 34 and 36 of the hoses 24 and 26, it can be easily removed. The free ends 34 and 36 of the inlet hoses 24 and 26 are then attached to the inlet water source.

FIG. 7 illustrates a cross-sectional view of the second access port 67 that allows access to the drain hose 22. Again, the cabinet 20 includes a back-up plate 74 that is located between the drain hose 22 and the access port 67 providing a continuation of the cabinet 20 and forming a bracket that is secured to the cabinet 20. A grommet 76 is utilized around an opening 77 in the bracket to provide a smooth surface over which the drain hose 22 is pulled or pushed.

A portion of the drain hose 22′ is pulled so that the end 40 of the drain hose exits the slit 138 of 38, is pulled through the access port 67 and is connected to a connector 71.

As illustrated in FIG. 6, the apparatus 10 also provides a means for storing the electrical cord 73 and plug 75. To this end, the plug 75 of the electrical cord 73 is received within apertures (not shown) on the back portion 79 of the apparatus 10. Accordingly, the apparatus 10 provides an automatic washing machine 10 wherein the cord 73 and plug 75, and necessary hoses 22, 24 and 26 are all safely stored for shipment yet provides an easy means for allowing selective access.

As is apparent from the foregoing specification, the invention is susceptible of being embodied with various alterations and modifications with may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A cabinet for an appliance wherein the appliance has at least one hose with a free end to be attached to a conduit external of the cabinet, and the hose is stored internally of the cabinet during assembly and shipping of the appliance, comprising:

an access port through said cabinet providing access to at least a portion of said hose;

connecting means mounted onto an interior portion of said cabinet adjacent to said access port for attaching a fixed end of said hose to said appliance said fixed end of said hose attached to said connecting means, the free end of said hose being stored internally of said cabinet inaccessible from said port;

whereby selective removal of said free end of said hose from within said cabinet may be effected by grasping said accessible portion of said hose.

2. A cabinet according to claim 1, wherein said port is disposed so that a portion of said hose is always visible and accessible through said port.

3. A cabinet according to claim 1, wherein said connecting means further includes a back-up plate located on a side of said hose opposite from said access port thereby allowing said hose to be accessed, but providing a contiguous structure to said cabinet.

4. A cabinet according to claim 3, wherein said hose is attached to said appliance by said connecting means comprising a valve assembly, said backup plate being secured to said valve assembly, and both being in turn secured to said cabinet.

5. A cabinet according to claim 3 wherein said back-up plate has an opening therein through which said hose passes.

6. A cabinet according to claim 5, wherein said opening in said back-up plate is provided with a grommet to provide a smooth surface over which the hose may be moved.

7. A cabinet according to claim 1, wherein a plurality of hoses are utilized by said appliance each of said hoses being accessible through said access port.

8. A cabinet according to claim 7, wherein a plurality of access ports are provided for accessing various ones of said plurality of hoses.

9. A cabinet according to claim 1, wherein said appliance also includes an electrical cord with a plug on the end thereof and apertures are provided on a back portion of said appliance cabinet for receipt of said plug.

10. In an automatic washer having two water inlet hoses fixed to said washer at a first end and having a free second end and a drain hose also fixed to said washer at a first end and having a free second end, for admitting and discharging wash fluid within said washer, and a cabinet enclosing said washer, a storage means for said hoses comprising:

access openings through said cabinet forming recessed areas in which said fixed end and an adjacent portion of said hoses are located during storage of said hoses interior of said cabinet, said free ends being positioned interior of said cabinet and being inaccessible from the exterior, said access openings thus providing access to said hoses from the exterior of said cabinet.

11. A storage means according to claim 10 further including a back-up plate forming a back wall of each of said recessed areas opposite from said access opening, said hoses being positioned between said access opening and said back-up plate thereby allowing said hoses to be accessed for removal from within said cabinet but providing a contiguous structure to said cabinet.

12. A storage means according to claim 11, wherein said inlet hoses are fixed to said washer by means of a valve assembly, said back-up plate being secured to said valve assembly, and both being in turn secured to said cabinet; said drain hose being fixed to said washer by means of a connector which passes through said back-up plate, said back-up plate having an additional opening therein for passage of said drain hose into the interior of said cabinet.

13. A storage means according to claim 12, wherein said additional opening in said back-up plate is provided with a grommet to provide a smooth surface over which the drain hose may be moved.

14. A storage means according to claim 10, wherein said washer also includes an electrical cord with a plug on the end thereof and apertures are provided on a back portion of said cabinet for receipt of said plug.

15. An automatic washing machine comprising:

an exterior cabinet;

two water inlet hoses at a first end to said washing machine, each having a free end attachable to a water supply conduit;

a drain hose attached at a first end to said washing machine and having a free end attachable to a drain conduit;

said cabinet having recessed areas therein;

said first ends being attached to said washing machine in said recessed areas of said cabinet;

said recessed areas having openings into the interior of said cabinet;

said free ends being stored internally of said cabinet and being inaccessible from the exterior thereof;

whereby, said hoses may be stored interior of said cabinet during assembly and shipping while being accessible from exterior of said cabinet at said recessed areas for removal of said free ends of said hoses from said cabinet.

16. An automatic washing machine according to claim 15, wherein said washing machine also includes an electrical cord with a plug on the end thereof and apertures being provided on a back portion of said cabinet for receipt of said plug.

* * * * *